US005193362A

United States Patent [19]

Otto

[11] Patent Number: 5,193,362

[45] Date of Patent: Mar. 16, 1993

[54] APPARATUS FOR TEXTILE TREATMENT

[75] Inventor: Wolfgang K. F. Otto, Spartanburg, S.C.

[73] Assignee: Milliken Research Corporation, Spartanburg, S.C.

[21] Appl. No.: 739,188

[22] Filed: Aug. 1, 1991

[51] Int. Cl.[5] ..... D06B 3/20

[52] U.S. Cl. ..... 68/175; 68/355

[58] Field of Search ..... 68/355, 119, 53, 131, 68/175, 177, 178, 179, 184, 190; 366/278

[56] References Cited

U.S. PATENT DOCUMENTS

| | | | |
|---|---|---|---|
| 15,066 | 6/1856 | Cushing . | |
| Re. 16,388 | 7/1926 | Edlich . | |
| 18,497 | 10/1857 | Butler et al. | 366/278 |
| 88,806 | 4/1869 | Peugh . | |
| 144,839 | 11/1873 | Dobson . | |
| 161,588 | 4/1875 | Bishop . | |
| 165,657 | 7/1875 | Bishop . | |
| 211,398 | 1/1879 | Haas | 68/119 |
| 304,402 | 9/1884 | Baush . | |
| 373,193 | 11/1887 | Rau . | |
| 742,716 | 10/1903 | Murphy . | |
| 813,839 | 2/1906 | Terramorse . | |
| 858,103 | 6/1907 | Place | 68/131 X |
| 1,217,129 | 2/1917 | Regout, Jr. . | |
| 1,357,118 | 10/1920 | Rone | 68/175 |
| 1,426,690 | 8/1922 | Vernay . | |
| 1,596,028 | 8/1926 | Spaulding et al. . | |
| 1,598,627 | 9/1926 | Voegeli | 68/175 X |
| 1,635,091 | 7/1927 | Lyth . | |
| 1,697,736 | 1/1929 | Rose et al. . | |
| 1,746,552 | 2/1930 | Nordquist et al. . | |
| 1,797,754 | 3/1931 | Bronander . | |
| 1,823,637 | 9/1931 | Wright | 366/278 X |
| 2,053,778 | 9/1936 | Platt | 26/28 |
| 2,067,632 | 1/1937 | Hadley | 26/28 |
| 2,107,607 | 2/1938 | Göbel | 26/25 |
| 2,129,707 | 9/1938 | Runton | 26/29 |
| 2,196,256 | 4/1940 | Dreyfus et al. | 91/70 |
| 2,219,128 | 10/1940 | Farr et al. | 26/27 |
| 2,521,440 | 9/1950 | Bannon | 68/179 X |
| 2,566,075 | 8/1951 | Taylor et al. | 26/26 |
| 2,699,592 | 1/1955 | Newnam | 26/18.5 |
| 2,730,786 | 1/1956 | Kindstrand et al. | 26/1 |
| 2,779,183 | 1/1957 | Farnelli | 68/175 |
| 2,963,893 | 12/1960 | Kusters | 68/175 |
| 3,061,905 | 11/1962 | Schiffers et al. | 68/178 X |
| 3,064,459 | 11/1962 | Messinger | 68/175 |
| 3,183,690 | 5/1965 | Zimmerli | 68/179 |
| 3,205,686 | 9/1965 | Norton | 68/38 |
| 3,313,240 | 4/1967 | Bentov | 103/151 |
| 3,477,109 | 11/1969 | Oonishi et al. | 26/2 |
| 3,540,242 | 11/1970 | Stearns | 68/175 |
| 3,640,101 | 2/1972 | Wilcox | 68/175 |
| 3,717,160 | 2/1973 | Tobias | 134/122 |
| 3,757,546 | 9/1973 | Ross | 68/44 |
| 3,881,329 | 5/1975 | Passier et al. | 68/175 |
| 4,012,815 | 3/1977 | Benzaquen | 26/28 |
| 4,018,068 | 4/1977 | Bertoldi | 68/175 |
| 4,038,842 | 8/1977 | Mizutani | 68/177 |
| 4,249,288 | 2/1981 | Iwata | 26/22 |
| 4,479,276 | 10/1984 | Ziegler | 8/152 |
| 4,480,362 | 11/1984 | Maxwell | 26/28 |
| 4,512,065 | 4/1985 | Otto | 26/28 |
| 4,607,409 | 8/1986 | Hishimuma et al. | 8/152 |
| 4,702,092 | 10/1987 | Turner | 68/53 |

FOREIGN PATENT DOCUMENTS

| | | | |
|---|---|---|---|
| 1092427 | 11/1960 | Fed. Rep. of Germany . | |
| 1146023 | 3/1963 | Fed. Rep. of Germany | 68/175 |
| 1097322 | 2/1955 | France | 68/178 |
| 1230246 | 3/1960 | France | 68/175 |
| 1-662 | 6/1984 | Japan . | |
| 320716 | 5/1957 | Switzerland | 68/177 |
| 737534 | 12/1978 | U.S.S.R. . | |
| 678585 | 9/1952 | United Kingdom . | |

*Primary Examiner*—Philip R. Coe

*Attorney, Agent, or Firm*—Kevin M. Kercher; H. William Petry

[57] ABSTRACT

An apparatus and method for rapid and repeated interchange between liquid in a tank and liquid or air trapped in fabric and/or yarn interstices. This allows for a more rapid and uniform penetration of liquid into interstices of a textile material such as fabric and/or yarn. This is accomplished by means of an oscillating member within the tank that creates a plane of liquid that impinges upn the face of said fabric and/or yarn. Some examples of potential applications, but by no means limited thereto, include desizing, scouring, chemical impregnation, bulking, and softening.

13 Claims, 6 Drawing Sheets

APPARATUS FOR TEXTILE TREATMENT

BACKGROUND OF THE INVENTION

This invention relates to a method and apparatus for textile treatment. This means of textile treatment involves both, the rapid and repeated interchange between liquid in a tank and liquid trapped in fabric or yarn interstices and the rapid removal of air from these interstices. Thus, the process results in the more uniform and complete penetration of processing liquid into all interstices and capillaries of the fabric and/or yarn. Some of the potential applications include, but are not limited to: desizing, scouring, and chemical impregnation. The force and frequency with which the processing liquid penetrates into the fabric interstices also frequently makes practical the use of the process for fabric bulking and softening.

There are a number of relatively noneffective technologies currently utilized in effecting increased liquid exchange between fabric interstices and the liquid in a tank or bath. One means of attempting this process is the use of submerged idler rolls which redirect the fabric in the bath in order to increase the fabric path length within the bath through which the fabric is processed. The movement of the fabric through the liquid results in some agitation of the processing liquid. This general agitation process still relies primarily on diffusion to remove materials from interstices and capillaries. The effectiveness of this well established concept is rather limited.

A second means of attempting to achieve increased liquid exchange is the use of a water jet prior to the fabric entering the bath with submerged idler rolls as described above or prior to entering a nip between baths. The forced penetration of liquid into interstices is only momentary and not complete or constant and can only be described as infrequent.

A third means of attempting to achieve increased liquid exchange is the use of submerged nip rolls within the tank with submerged idler rolls. Once again, the forced penetration of liquid into interstices is only momentary and not complete or constant and can only be described as infrequent.

A fourth means of attempting to achieve increased liquid exchange is the use of a submerged suction slot formed in a roller and used in conjunction with submerged idler rolls as described in the first means above. This suction slot attempts to draw liquid through the fabric as the fabric passes this roller. As before, the forced penetration of liquid into interstices is only momentary and not complete or constant and can only be described as infrequent.

A fifth means of attempting to achieve increased liquid exchange is the use of a single rotary perforated drum with suction applied to the inside of the drum. This drum is submerged within a tank. This is a mechanically complicated device which can inflict fabric damage and is typified by being beset with sealing difficulties. The effectiveness, however, is a slight increase over these first four means.

A sixth means of attempting to achieve increased liquid exchange is the use of series of idler rolls located both above and below the bath. When the fabric passes between a lower roll submerged in the bath and an upper roller extending above, some excess liquid is removed by means of ultrasonic sound waves, applied to the fabric above the surface of the liquid in the tank.

Also, water spray may be applied to the fabric in the region of application of ultrasonic sound waves to achieve increased liquid exchange. Both these means achieve only a few additional cycles of liquid penetration into the fabric interstices per pass by means other than the naturally occurring, slow process of diffusion. Furthermore, the equipment is relatively costly. It is believed that ultrasonic pulsing generates a great deal of micro-turbulence and cavitation within the fabric interstices and at the solid-liquid interfaces but does not result in a significant increase in the exchange between the liquid in the fabric and the liquid in the bath.

U.S. Pat. No. 3,183,690, issued to Zimmerli, discloses a device that creates a great deal of turbulence by yieldable wall areas. This produces a "sinuous wave action" that presents a sharp contrast to a plane of liquid.

U.S. Pat. No. 3,064,459, issued to Messinger, discloses an oscillating screen that is utilized to transport fabric by friction possibly resulting in abrasion and chafing. In this case, the screen is used to force the fabric through liquid as opposed to contacting the fabric with a plane of liquid.

The present invention solves these problems in a manner not disclosed in the known prior art.

SUMMARY OF THE INVENTION

An apparatus and method for achieving rapid and repeated penetration of liquid into fabric interstices or yarn capillaries and interchange between liquid in a tank and liquid trapped in said fabric interstices or yarn capillaries are provided. This is accomplished by means of an oscillating member within the tank that creates a plane of liquid that impinges upon the face of said fabric and/or yarn. Some examples of potential applications, but by no means limited thereto, include desizing, scouring, chemical impregnation, bulking and softening.

It is an advantage of this invention to have more uniform penetration of the processing liquid into interstices of fabric and/or yarn that is both efficient and effective.

Still another advantage of this invention is a faster and more complete removal of size or contaminants from fabric and/or yarn.

Another advantage of this invention is the rapid removal of air from fabric and yarn interstices and the rapid wetting of fabric.

A further advantage of this invention is the bulking and softening of the fabric by the force of the penetration of the liquid and the resulting movement of the fibers and yarns of the fabric relative to each other.

Yet another advantage of this invention is the relatively simple mechanical structure and associated low initial construction costs and maintenance costs.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which.

DETAILED DESCRIPTION OF THE PREFERRED EMBODIMENT

Figure 1:
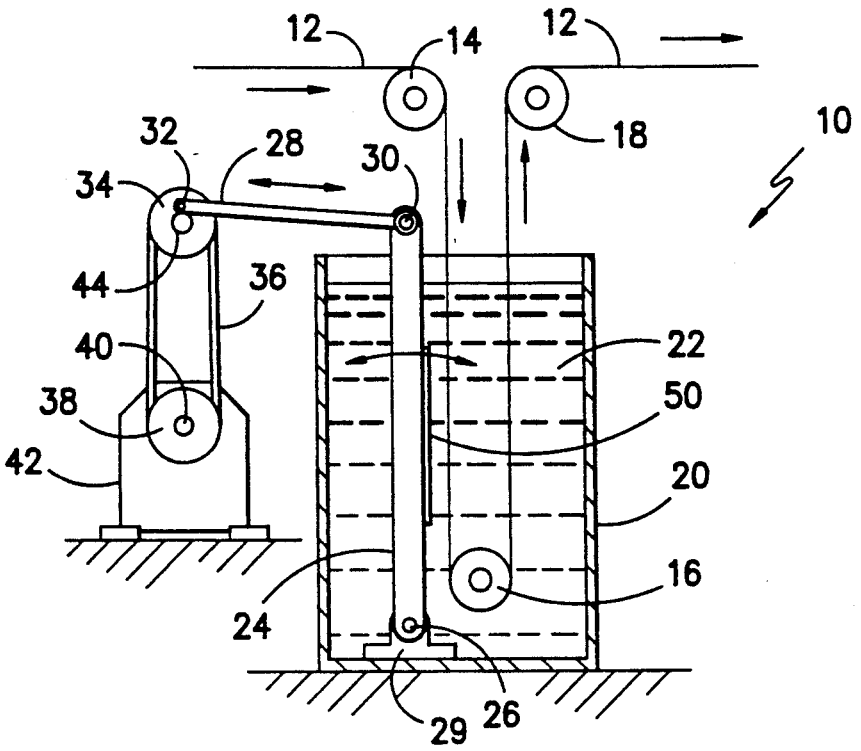
FIG. 1 is a schematic side elevational view of a textile treatment apparatus according to the present invention wherein an action member having a relatively flat treatment portion on one side is pivotally oscillated before a moving web of fabric.

Referring now to the accompanying drawings, and initially to FIG. I, which shows an overall side elevational view of a textile treatment apparatus generally indicated by reference numeral 10. The basic textile treatment apparatus includes a main container or tank 20, which contains the processing liquid 22, shown in FIGS. 1-4. This processing liquid 22 can be any of a wide spectrum of chemicals including water, aqueous solutions and/or dispersions of dyestuff, of polyacrylic acid,.polyvinyl alcohol, alkali, acids, surfactants, scouring agents, enzymes, polymers, such as acrylic polymers, vinyl acetate polymers, urethanes and of copolymers and mixtures thereof, of water repellents, of soil release agents, catalysts and flame retardants. This processing liquid may be solvents or mixtures of solvents or mixtures of solvents with water and these mixtures may again contain solutes and/or dispersed materials and so forth. This list is not exclusive and includes any liquid, which is desired to penetrate the interstices of fabric and/or yarn.

A moving web of textile fabric 12 is transported through the tank 20 over a series of three idler rolls 14, 16 and 18. The textile web 12 first encounters idler roll 14 prior to processing, which directs the textile web 12 downward into the tank 20. Submerged idler roll 16 redirects the textile web 12 back out of the tank 20. Upon exiting the tank 20, the textile web 12 is redirected by idler roll 18 back into a horizontal plane of travel similar to that exhibited prior to entering the tank 20.

There is an action member 24 that has a treatment portion 50 that can take the form of a detachable plate, which performs the fabric treatment by oscillating back and forth and creating a plane of liquid substantially parallel to the textile web 12, which travels in a direction substantially normal toward the face of the fabric and forces an exchange of liquid between the tank 20 and the interstices of the textile web 12.

The action member 24 is in the form of two rectangular segments 64, 65 respectively, as shown in FIGS. 5-9, that are mounted at a ninety degree angle to said treatment portion 50. There are holes 70 that allow for the receiving of pins at each opposed end of rectangular segments 64 and 65 respectively, as shown in FIGS. 5-9. The action member 24, further defined as logically consisting of two end portions where one end portion is pivotally connected to the bottom of the tank 20 by means of a pin 26 attached to a support member 29 having a socket or other type of pin receiving apparatus. The upper end portion of the action member 24 is actuated by means of a linking arm 28 logically defined by two end portions where one end portion is pivotally attached to the action member 24 by means of a connecting pin 30. The opposite end portion of the linking arm 28 is also pivotally connected by a pin 32 to a pulley 34. This pivotal connection of pin 32 is offset from the shaft 44 upon which the pulley 34 rotates. This pulley 34 is rotated by means of an endless belt 36. The endless belt 36 driven by another pulley 38 driven by means of a rotating shaft 40 which is part of motor 42. The shaft 44 can rotate over a wide range of speeds, with the maximum operating range between 5 to 20,000 revolutions per minute with a more practical range between 20 to 10,000 revolutions per minute with the optimal preferred speed being between 60 to 6,000 revolutions per minute. Please keep in mind that these parameters are for this type of embodiment only and other embodiments having piston-type arrangements could be different. The preferred motor is an electric motor, capable of delivering at least approximately 1/20 horsepower or more per square foot of treatment portion and preferably much more although any of a wide variety of motors of sufficient horsepower will suffice including those that are hydraulic, pneumatic, and so forth. With a different drive linkage, oscillating mechanisms such as solenoids, hydraulic or pneumatic pistons can be used. The preferred embodiment is illustrative of a means to oscillate an action member to create a plane of liquid. This is in the form of a rocking motion. There are numerous other means of accomplishing this same goal of creating a plane of liquid by means of oscillation and all of these mechanical connections will be construed as mechanical equivalents.

An important factor in the exchange rate between the processing liquid in the tank 20 and the interstices of the textile web 12 is the treatment portion 50 of the action member 24. This treatment portion 50 can have any of a wide variety of apertures located therein that can encompass the full spectrum of geometric shapes.

Figure 5:
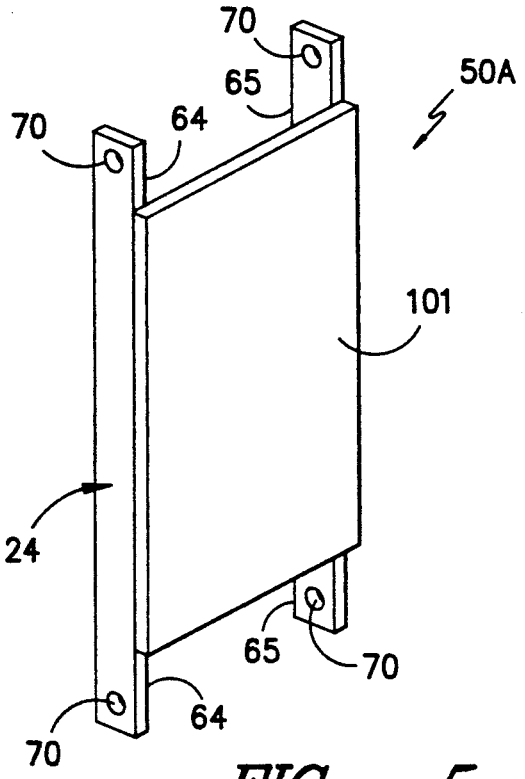
FIG. 5 is a perspective view of the action member with a treatment portion comprising a solid flat plate.
Figure 6:
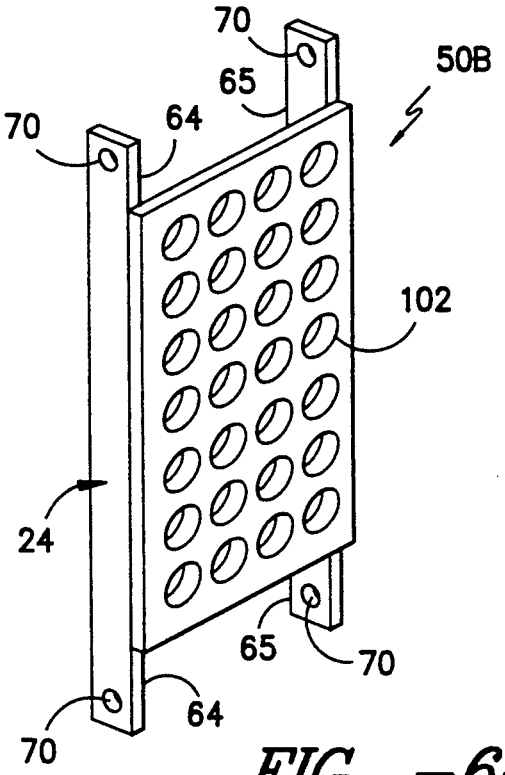
FIG. 6 is a perspective view of the action member with a treatment portion having a flat plate with a plurality of circular openings.
Figure 7:
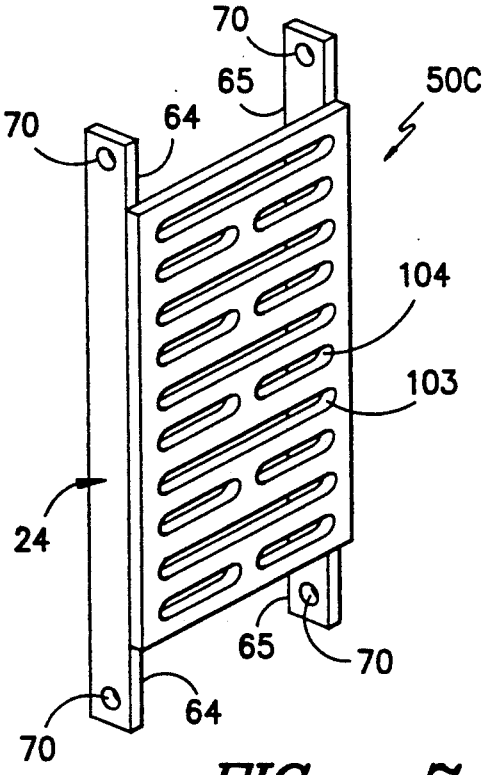
FIG. 7 is a perspective view of the action member with a treatment portion having a flat plate with a plurality of elliptical openings.
Figure 8:
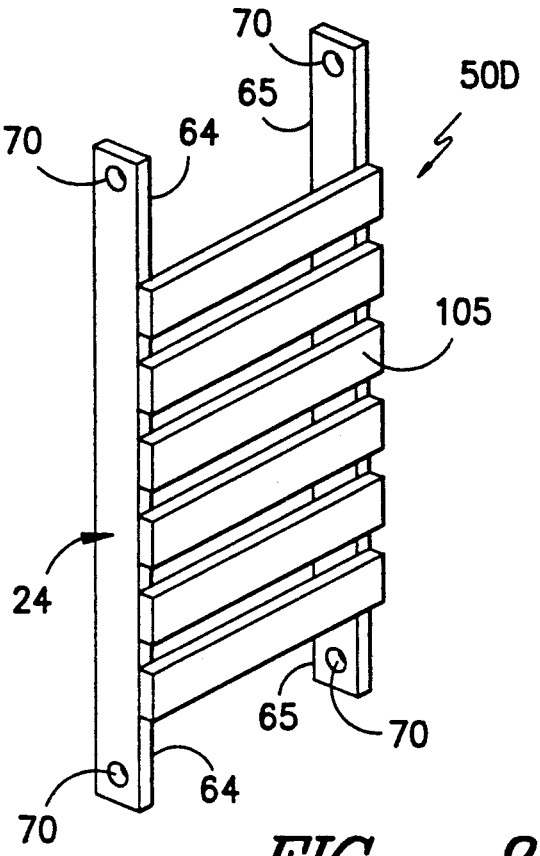
FIG. 8 is a perspective view of the action member with a treatment portion comprising of a plurality of rectangular slats.
Figure 9:
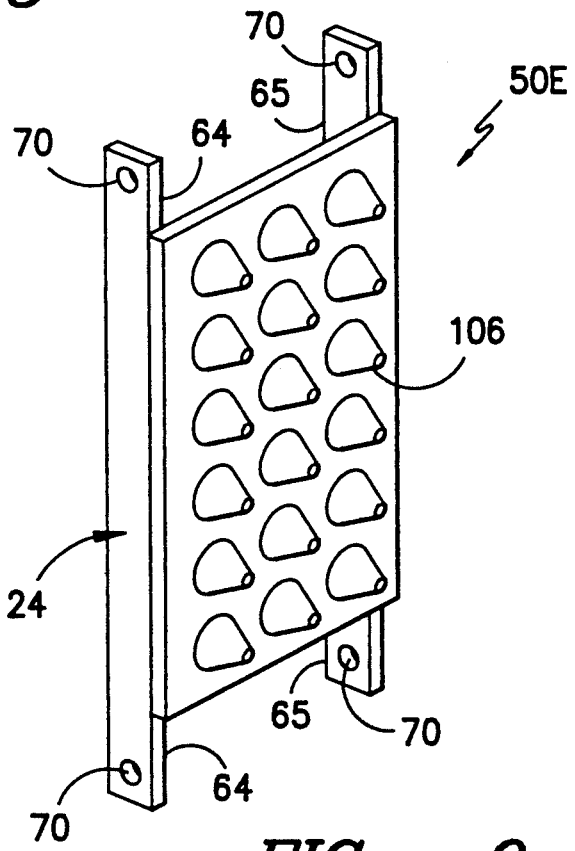
FIG. 9 is a perspective view of the action member with a treatment portion comprising of a plurality of conical shapes projecting therefrom.

Referring now to FIGS. 5, 6, 7, 8 and 9, the treatment portion 50A is illustrated as a solid flat surface 101 in FIG. 5. In FIG. 6, the treatment portion 50B is illustrated as a series of circular apertures 102, which are aligned both vertically and horizontally. FIG. 7 discloses a series of elliptical shapes comprising treatment portion 50C. There is an alternating series of one longer elliptical aperture 103 on one row followed by a row of two elliptical apertures 104 of relatively the same width on the second row. This pattern is repeated throughout this treatment portion 50C. In FIG. 8, the action member 24 is connected by a series of rectangular slats 105 which make up treatment portion 50D. Furthermore, the addition of various projecting elements of various symmetrical and non-symmetrical shapes extending from the treatment portion 50 is also considered as a very viable treatment option. In FIG. 9, the treatment portion 50E has a series of conical shapes 106 projecting therefrom. These five examples are meant to display some of the variety available in treatment portions and should not be held to be limiting in any way. It is believed that the preferred embodiment is a substantially flat portion.

Figure 2:
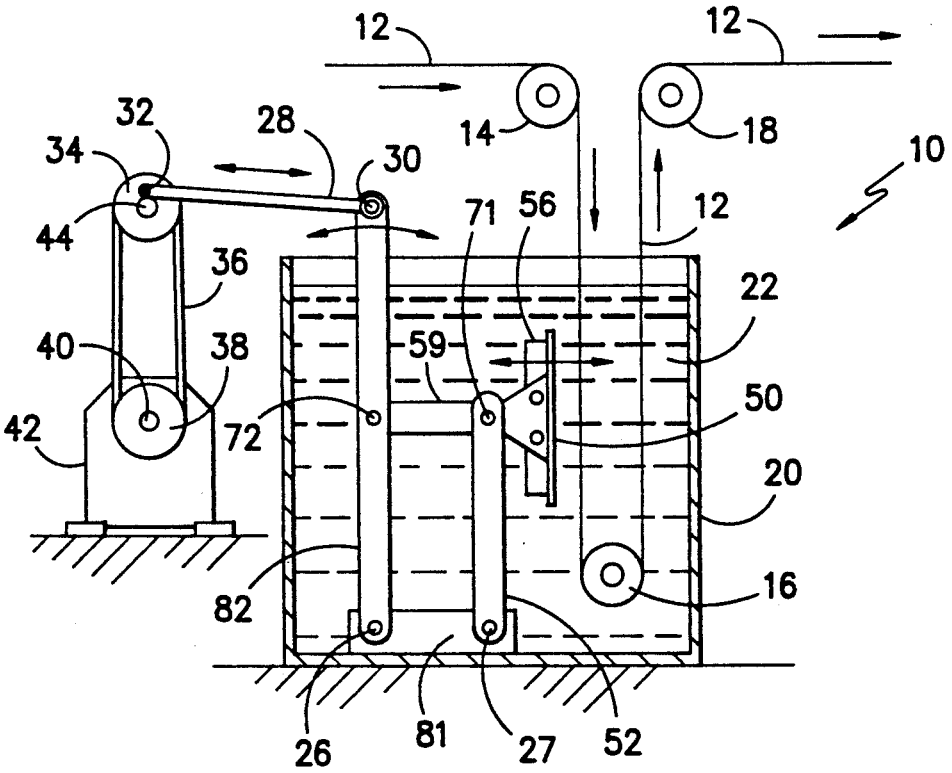
FIG. 2 is a schematic side elevational view similar to FIG. 1 showing a modification thereof wherein said action member is oscillated in a direction substantially perpendicular to a moving web of fabric.

Referring now to FIG. 2, which is an alternative embodiment of the embodiment disclosed in FIG. 1. There is a first arm 82, which is logically defined by a first end portion, a middle portion and a second end portion and a second arm 52, which is logically defined by a first end portion and a second end portion. The first end portion of the first arm 82 and the second arm 52 are both pivotally connected to support member 81 by rods or pins 26 and 27, respectively. This is in the same manner as action support member 24 is attached to support member 29 by pin 26 in the previously disclosed embodiment. There is an action member 56 having a relatively flat treatment portion 50 that is attached to a linking arm 59. This embodiment generates parallel planes of liquid that are more perpendicularly aligned with the bottom of the tank then those produced by the previous embodiment. The treatment portion 50 is moved toward the face of the fabric web 12 in a direction substantially normal to the face of the fabric web 12. The previous embodiment presents more of a "rocking" motion and thus this second embodiment is believed to be more effective in the liquid exchange between fabric interstices and the liquid in the tank. However, this second embodiment is more mechanically complex, which increases the cost and reduces the reliability and may operate to negate the increase in efficiency. The linking arm 59 is pivotally connected at the second end of second arm 52 by pin 71 and linking arm 59 is also pivotally connected by pin 72 to the middle portion of first arm 82. The upper portion of the first arm 82 is actuated in the same oscillatory manner as action member 24 as previously disclosed in the first embodiment. The web of textile fabric 12 transport mechanism includes idler rolls 14, 16 and 18, which is also previously disclosed above. There are a number of mechanically equivalent means to achieve this same effect such as a spring loaded cam and cam follower, a piston and cylinder, and an electric solenoid, and so forth. The aforementioned list is by no means to be deemed exclusive and can include any mechanical arrangement that forces the member back and forth to create a plane of liquid.

Figure 3:
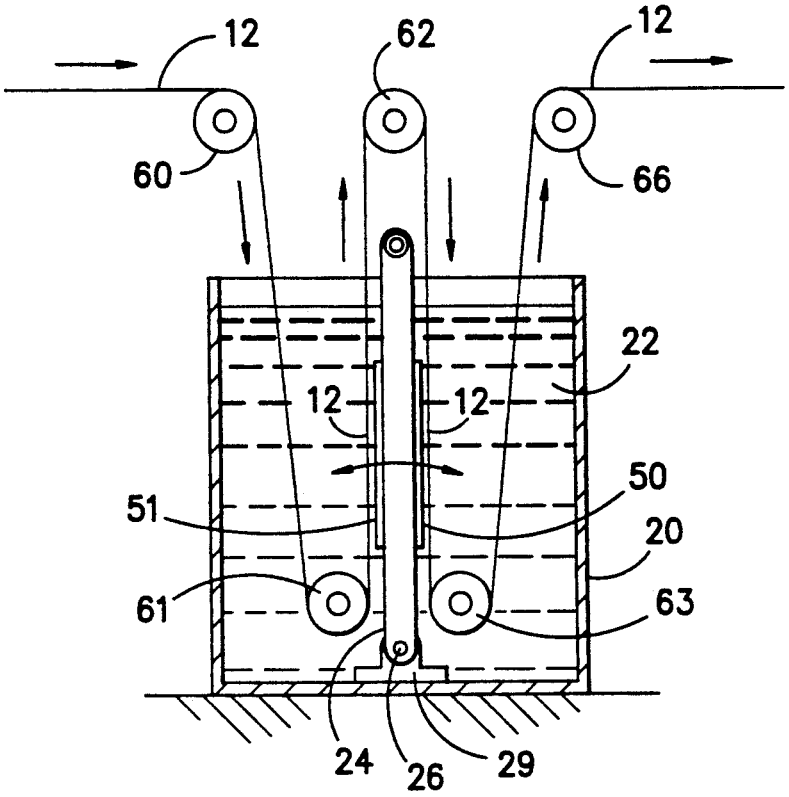
FIG. 3 is a schematic side elevational view of a textile treatment apparatus according to the present invention wherein an action member having a relatively flat treatment portion on each side is pivotally oscillated with a moving web of fabric positioned on each side of the action member.

Referring now to FIG. 3, which discloses an identical fabric treatment apparatus to that revealed in FIG. 1 with the exception that there is a second treatment portion 51 mounted to the action member 24 on the side opposite treatment portion 50. The web of fabric 12 is directed into the tank 20 by idler roll 60 and redirected back out of the tank by idler roll 61. The web of fabric 12 is redirected back into the tank 20 by idler roll 62. Idler roll 62 is located substantially above the pivoting action member 24. The web of fabric 12 is then directed out of the tank 20 by idler roll 63 and is directed by idler roll 66 in a substantially horizontal plane in the same general direction in which it was travelling prior to the initial redirecting by idler roll 60. By this process, the moving web of fabric 12 is treated by two treatment portions 50 and 51 simultaneously by a single action member 24. Idler rolls 60, 62 and 66 are located outside of the tank 20, while idler rolls 61 and 63 are fully submerged within the tank 20. The number of fabric loops that traverse the tank 20 as well as the number of treatment portions and action members can be varied extensively.

Figure 4:
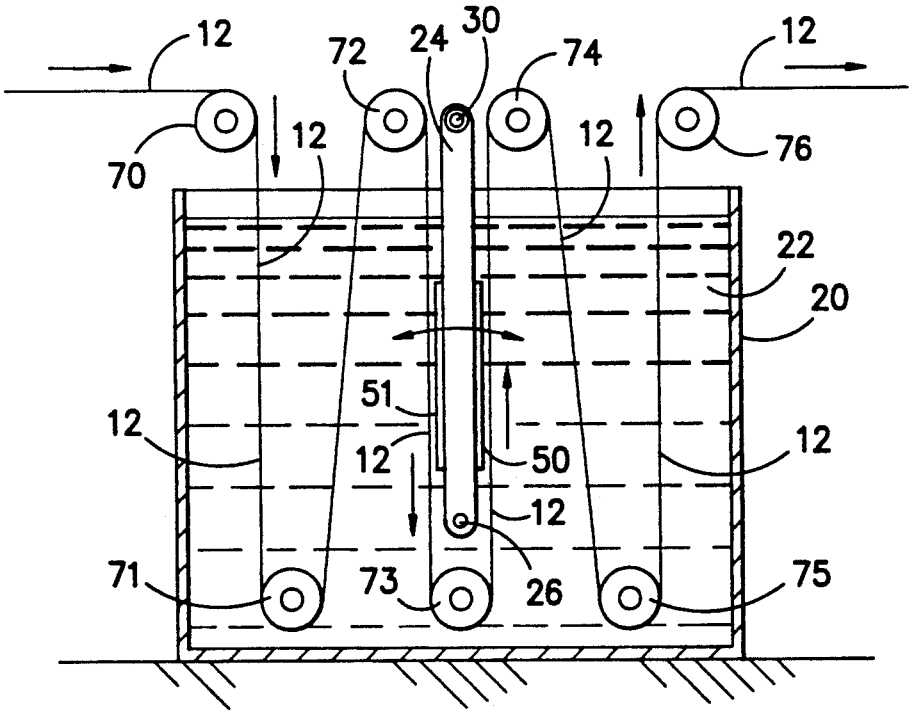
FIG. 4 is a schematic side elevational view similar to FIG. 3 showing a modification thereof wherein said action member having a relatively flat treatment portion on each side is pivotally oscillated with a moving web of fabric positioned underneath and on each side of the action member.

Another embodiment is detailed in FIG. 4, in which the pivot pin 26 for the action member 24 is connected at an intermediate portion of the tank 20 and not to a support member 29 on the bottom of the tank 20 as shown in FIGS. 1, 2 and 3 The fabric web 12 enters from a substantially horizontal plane, which is not required, and is directed into the tank 20 by idler roll 70 and then redirected out of the tank 20 by idler roll 71 and back into the tank 20 by idler roll 72. The web of fabric 12 then is redirected back out of the tank 20 by idler roll 73 that is located substantially underneath pin 26 upon which action member 24 oscillates. Action member 24 has treatment portions 50 and 51 located on each side to treat the fabric both prior to coming in contact with idler roll 73 and after leaving idler roll 73. The web of fabric 12 then leaves the tank 20 and is redirected back by idler roll 74 and forms another loop in conjunction with idler roll 75 that is responsible for redirecting the web of fabric out for the last time. The fabric is then directed in a substantially horizontal plane by means of idler roll 76. Therefore, in this embodiment, idler rolls 70, 72, 74, and 76 are located above the tank 20 and idler rolls 71, 73 and 75 are located within the tank 20. This is yet a further example of how the number of fabric loops that traverse the tank 20 as well as the positioning of the action member 24 can be varied extensively. The upper portion of action member 24, in both FIGS. 3 and 4, can be actuated in a manner substantially similar to that previously disclosed in the first embodiment, by an oscillating linking arm pivotally attached to connecting pin 30. Furthermore, the treatment portions utilized in all four illustrative embodiments disclosed in FIGS. 1, 2, 3 and 4 can vary extensively with regard to apertures and projections thereon or lack thereof with FIGS. 5, 6, 7, 8 and 9, being detailed as a matter of illustration only.

Critical parameters of this invention include the oscillation frequency and the oscillation amplitude of the action members. These two parameters interact with each other, so that for the same degree of effectiveness, within limits, a smaller amplitude combined with a higher frequency may have the same result as a larger amplitude combined with a lower frequency. We are therefore defining a derivative parameter, namely the Effectiveness Factor F, as that value which is obtained by multiplying the oscillation amplitude in inches with the oscillation frequency in revolutions or cycles per minute. The dimension of this Effectiveness Factor F is (Inches×Cycles/Minute). While the relationship between the Effectiveness Factor F on the one hand and the actual process effectiveness on the other hand is not linear, F is one useful parameter in defining the process limits if it is used in conjunction with limits for other parameters as set forth below. F has an outer limit of 3 to 1500 (Inches×Cycles/Minute) with a more practical range of 10 to 1000 (Inches×Cycles/Minute) with a preferred range of 15 to 700 (Inches×Cycles/Minute) as the optimal operating condition.

Another important parameter is that of the distance of the substrate, e.g., fabric, to the treatment portion. As the treatment portion travels through its cycle, the fabric will move slightly but will not move even remotely at the oscillating frequency and amplitude of the treatment portion. Therefore, the distance between the treatment portion and the fabric will vary during the oscillation cycle. The term "distance" as used to define the outer limits is the distance between the fabric and the treatment portion when the fabric is not deflected by the effect of the process from its normal path and/or its support and the treatment portion is at the center of its cycle and parallel to the fabric. There is no absolute minimum distance since the process is believed to be most effective the smaller this distance is, provided that the treatment portion during its cycle does not contact the fabric to a degree which will result in fabric damage by chafing or abrasion. The maximum outer limit varies with the parameters and can not be readily ascertained. One-half (½) of an inch or less is the optimal operating condition and experience has shown that this distance can be extended significantly with decreasing effectiveness.

A further factor of importance is the area of the treatment portion which can vary widely, with no real absolute upper limit and the lower limit being that area, which is so minuscule as to negate the creation of a plane of liquid.

The final factor of importance is the duration of fabric exposure to the liquid bath as a whole, but more importantly the duration of fabric exposure to the sum of all treatment portions. There may be only one treatment portion in a treatment range but frequently there will be multiple treatment portions. The aforementioned total duration is determined both, by the total extent of all treatment portions in the direction of travel of the fabric and by the fabric speed and would appear to be a very crucial variable in determining the final outcome of the result. The outer limit of duration of total fabric exposure to the treatment portions can range from 0.1 to 600 seconds with a more practical range of 0.5 to 120 seconds and a preferred range of 1 to 60 seconds as the optimal operating condition. There are a number of other factors present, such as the temperature of the liquid and other, chemical characteristics and parameters which determine the effectiveness of the process for a particular application.

The orientation of the plane of liquid within the tank is substantially irrelevant. An example of this is an alternative embodiment disclosed in FIGS. 10–13. In this case, the plane of liquid is horizontally aligned with the bottom of the tank as opposed to being vertically aligned with the side of the tank as previously disclosed.

Figure 10:
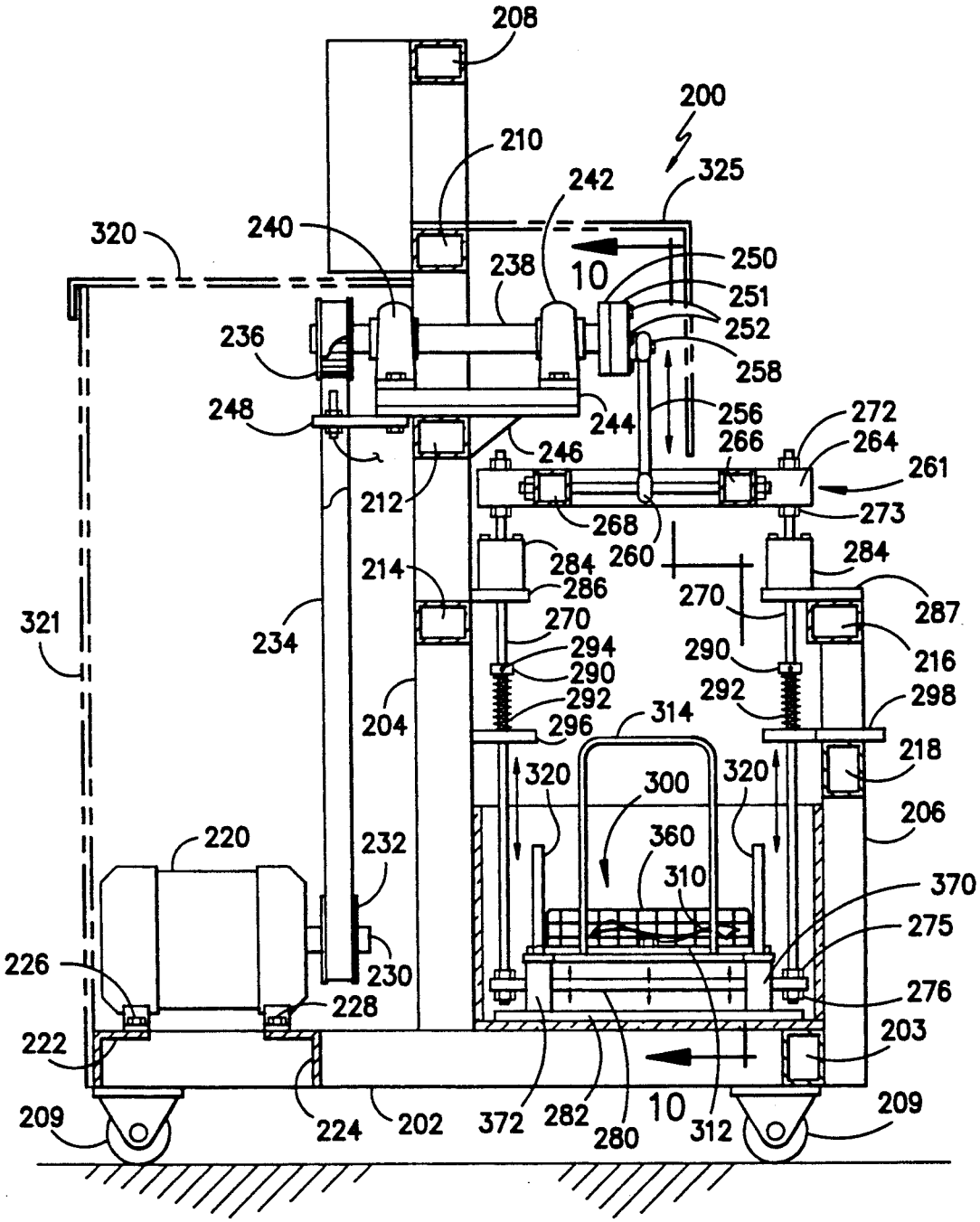
FIG. 10 is a sectional side elevational view of an alternative embodiment of a textile treatment apparatus according to the present invention wherein an action member is oscillated in a direction substantially normal to the bottom of a tank of liquid and the fabric.

Referring now to FIGS. 10 through 13 and initially to FIG. 10, a fragmentary side elevational view of an alternative embodiment of a textile treatment apparatus is generally indicated by numeral 200. This textile treatment apparatus has a horizontal base frame 202 upon which a dual set of vertical members 204 and 206, respectively, are either mounted or an integral part thereof. The horizontal base frame 202 has four wheels 209 or equivalent mounted thereto as a means for providing mobility to the apparatus 200. There is a horizontal base member 203 that is a component of the horizontal base frame 202 and positioned near the front of the apparatus 200. The dual set of vertical members 204 have four horizontal support members 208, 210, 212 and 214 going from top to bottom, respectively, therebetween. The dual set of vertical members 206 have horizontal support members 216 and 218 also going from top to bottom, respectively, therebetween. This mechanism is driven by a motor 220, which as previously mentioned is preferably an electric motor, capable of delivering approximately 1/20 to 50 horsepower or more per square foot of treatment portion although any of a wide variety of motors of sufficient horsepower will suffice including those that are hydraulic, pneumatic, and so forth. With a different drive linkage, oscillating mechanisms such as solenoids, hydraulic or pneumatic pistons can be used. This motor 220 is attached to the horizontal base frame 202 by two L-shaped brackets 222 and 224 and associated nut and bolt combinations 226 and 228, respectively, but any of a host of known attachment means including hardware, adhesives, welding, and so forth, will suffice in this connection as well as any throughout this Application. The motor 220 has a rotating shaft 230 having a first pulley 232 attached thereto. An endless belt 234 is attached to said first pulley 232 and is utilized to drive a second pulley 236. Second pulley 236 has a rotating shaft 238 attached through the center of and in a direction normal to the face of the second pulley 236. The rotating shaft 238 is supported by two bearing assemblies 240 and 242, respectively. Bearing assemblies 240 and 242 are attached to dual support member 244, which is held in place by angle bracket 246 that is attached to horizontal support member 212. On the bottom of the dual support member 244 is attached a sensor 248 to count the revolutions of the second pulley 236. Any connections, such as that between the sensor 248 and the dual support member 244, utilized in this application are by conventional hardware, i.e., nuts and bolts, however, any known means of interconnection will suffice such as adhesives, welding, and so forth as previously mentioned.

Figure 11:
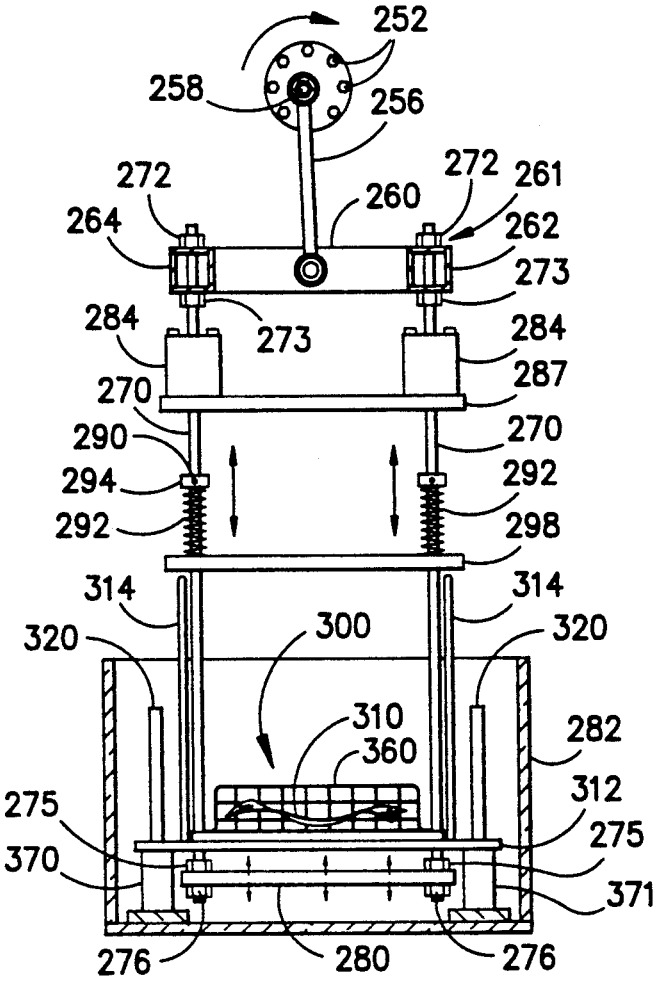
FIG. 11 is a cross-sectional view taken on line 10—10 of FIG. 10.

The opposite end of the rotating shaft 238 is connected to a first and second circular disk segments 250 and 251, respectively, connected in a face to face relationship by a series of six bolts 252 through the second circular disk segment 251 and into threaded openings in the first circular disk segment 250. Slightly offset from the center of the second circular disk segment 251 is rotatably connected a vertical oscillating member 256, in the form of a crank arm, by means of a bolt and washer combination 258, as is also shown in FIG. 11. This vertical oscillating member is pivotally connected to a middle segment 260 of a rectangular frame 261 having right side portion 262 and left side portion 264, as viewed in FIG. 11, extending perpendicular to and on each opposite end portion of the middle segment 260. There is also a front segment 266 and a back segment 268, which is parallel to and on opposite sides of middle segment 260, as shown in FIG. 10. Therefore, the rectangular frame 261 is formed of front segment 266, back segment 268, right side portion 262 and left side portion 264.

The front and back end of both side portion 262 and side portion 264 have four rods 270 located at the relatively opposite end portions of the side portions 262 and 264. These four rods 270 are directed substantially vertically downward and connected to side portions 262 and 264 by a nut 272 located above and a nut 273 located below side portions 262 and 264 respectively. These four rods are attached to the four corners of the treatment portion 280, in the form of a plate, that generates the parallel plane of liquid as previously described. The rods 270 are attached to the treatment portion 280 by a nut 275 located above the treatment portion 280 and a nut 276 located below the treatment portion 280, as shown in FIGS. 10 and 11. The rods 270 are held in place by four combination guide and bearing mechanisms 284 in which the two mechanisms located toward the back of the apparatus 200 are connected to horizontal platform 286 located near horizontal support member 214, and the two mechanisms located near the front of the apparatus 200 are connected to horizontal platform 287 attached to the top of horizontal support member 216. Each rod 270 will move the treatment portion upward more readily due to a spring 292 that is held in place by flange member 290 that is held to the rod 270 by means of a set screw 294. The back two rods 270 compress each spring against a back support platform 296 attached to vertical member 204 and the front two rods 270 compress the spring against a front support platform 298 that is located on top of horizontal support member 218.

Treatment portion 280 is located within a tank 282. This tank 282 in this embodiment is rectangular, and can be of any shape or size. There is a textile holding apparatus generally indicated by numeral 300. There are four support members 370, 371, 372 and 374 (not shown) respectively, which form a foundation for the textile holding apparatus 300 and are mounted to the bottom of the tank 282. Support member 371 is located in front and on the right hand side from the perspective of FIG. 11. Support member 374 is located directly in back of support member 371 and is not shown. Support member 370 is located to the left of support member 371 and is also shown in FIG. 10 in addition to FIG. 11. Support member 372 is located directly in back of support member 370, as shown in FIG. 10.

Figure 12:
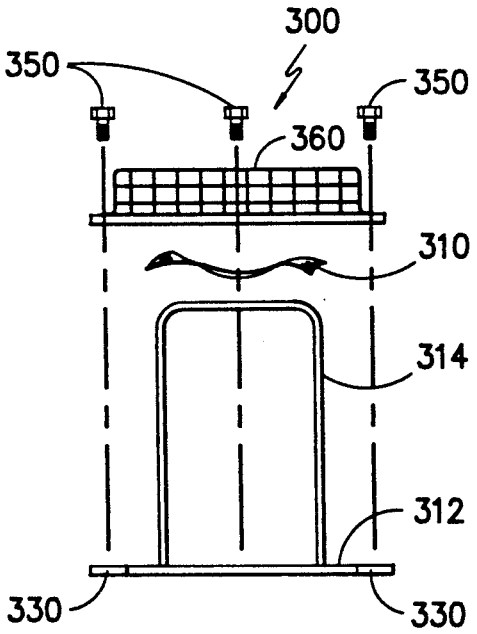
FIG. 12 is an exploded and isolated front elevational view of a fabric treatment containment apparatus including fabric, basket-type mechanism and attachment means.
Figure 13:
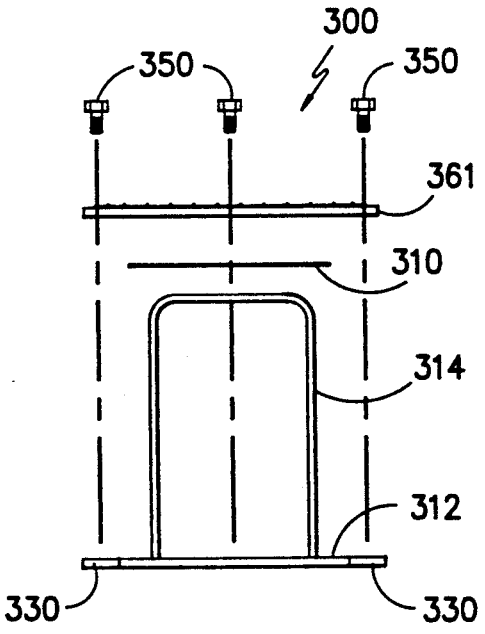
FIG. 13 is an exploded and isolated front elevational view of a fabric treatment containment apparatus similar to FIG. 12, however, with a substantially flat screen-type mechanism substituted for the basket-type mechanism.

As disclosed in greater detail in FIG. 12, in conjunction with FIGS. 10 and 11, a textile fabric swatch 310 is held within a basket-type mechanism 360 over the top of the swatch 310 with a screen member 312 below the textile fabric swatch 310 and close to the treatment portion 280. There is a handle mechanism 314 on each side of the screen member 312 that is attached or integrally connected thereto. There are four posts 320 attached to the top of the four support members 370, 371, 372 and 374 respectively, and are projecting upwardly therefrom. These four posts 320 hold the screen member 312 in a fixed position by means of holes 330 located on the four corners of the screen member 312, as shown in FIGS. 12 and 13. There are bolts 350 to attach the basket-type mechanism 360 to the screen member 312, as shown in the exploded view of FIG. 12.

Therefore, the offset attachment of vertical oscillating member 256, in the form of a crank arm, will move the rods 270 in conjunction with the springs 292 to oscillate the treatment portion 280 up and down, thereby creating a plane of liquid that will force an exchange of liquid between the liquid in the tank 282 and the liquid in the interstices of the textile fabric swatch 310. This embodiment demonstrates that the plane of liquid can be generated from any angle and should not be limited to a textile swatch, since it could also easily be adapted to a moving web of fabric. This textile treatment apparatus can be enclosed such as by vertical panel 321 and horizontal panel 320 which envelope the motor 220, first pulley 232, second pulley 236, endless belt 234 and rotating shaft 238. There is a L-shaped housing 325 that encloses the rotating shaft 238, bearing assembly 242, first circular disk segment 250, second circular disk segment 251 and the vertical oscillating member 256.

As shown in FIG. 13, a second flat screen member 361 can be substituted for the basket-type mechanism 360 to hold the textile fabric swatch 310 in a fixed location that is aligned substantially parallel to the bottom of the tank. It is believed that the more parallel the fabric is to the plane of liquid, the more effective the exchange of liquid becomes between the tank and the interstices of the fabric.

It is important to note that an equivalent means of performing this operation is to move the fabric against a plane of liquid instead of moving a plane of liquid against a fabric. Therefore, all of the embodiments shown and described could be modified to move the fabric in a direction substantially traverse to a plane of liquid and the results would be substantially the same. This could be done by substituting the treatment portion for a porous mechanism that can hold the fabric while it is oscillating the fabric through the tank of liquid. An illustrative example of this porous mechanism, but not limiting, could consist of two screens as shown in FIG. 13, only with this structure attached to the rods 270 for vertical movement. This two screen concept also could be substituted for the flat treatment portion 50, 51 of FIGS. 1, 2, 3 and 4. This mechanism could even work with a moving web of fabric if the holding mechanism not only moved the fabric traverse to a plane of liquid but also allows the fabric to move within the holding mechanism to leave the confines of the tank after treatment.

Therefore, it is not intended that the scope of the invention e limited to the specific embodiments illustrated and described. Rather, it is intended that the scope of the invention be defined by the appended claims and their equivalents.

EXAMPLES

The greige fabric used in the following Examples was a 2×1 Twill constructed from 14.0/1 open end spun warp and fill yarns. Both, warp and fill yarns contained an intimate blend of 65% Cotton and 35% Polyester staple. The fabric "width in reed" was 69.9 inches. The fabric greige weight was approximately 0.82 Lbs/Yard of cloth. The warp was sized with DuPont Elvanol T66 ® manufactured by E. I. duPont Nemours and Co. whose principal place of business is located in Wilmington, Del. Polyvinyl Alcohol size and the total nominal size content as percent of fabric weight was 7.08%.

Two methods were used to analyze for size content. In the extraction method, approximately 5×5 Inch samples were first extracted exhaustively with hexane in a Soxhlet extractor. After pre-drying and weighing, the samples were extracted for 2 hours at between 200 and 212 Degrees Fahrenheit with water which contained sufficient soda ash to achieve a pH value of between 10 and 11. The liquor to sample weight ratio was approximately 200 to 1. The sample was subsequently rinsed with water, dried and weighed. The weight loss as a percentage of the sample weight prior to water extraction was reported as "Water Extractables". The Water Extractables consisted primarily of polyvinyl alcohol size but also contained approximately between 0.4% to 1.1%, calculated as a percent of dry fabric weight before water extraction, of other, mostly unidentified, materials such as polysaccharides.

The second test method used was the sensitive, semi-quantitative, polyvinyl alcohol specific "DuPont Spot Test for Polyvinyl Alcohol", developed and supplied by E. I. duPont Nemours and Co., which permits determination of the polyvinyl alcohol content of a white sample in a range of between 0.05% to 1.0%.

Greige fabric as received, if extracted by the aforementioned method, had Water Extractables of 6.21±0.23%.

For the cited Examples, the samples were approximately 14 inches wide and 18 to 20 inches long. They were placed in a metal frame under a warp tension of 20 Lbs. per 14 Inches width with no filling tension. After processing, samples were cut for Extraction Analysis and Spot Test Analysis from that area which during the experiment had been disposed opposite the action member.

EXAMPLE 1

The tank of a machine substantially as shown in FIG. 1 and previously described was filled to within approximately 2 Inches of the upper rim with water of more than 185 Degrees Fahrenheit so that the 12×12 Inch action portion, Which in this case is a plate, was completely immersed in water. The action portion was oscillated at 2000 Cycles per Minute at an amplitude of 0.125 Inches giving an Effectiveness Factor of 250 Inches×Cycles/Minute. A frame mounted dry fabric sample as described above was rapidly inserted into the tank so that it was disposed parallel to the treatment portion at a distance of 0.5 Inches. Due to the instant displacement of the air entrapped in the fabric and yarn interstices a large number of small air bubbles immediately burst forth from the fabric surface, demonstrating the effectiveness of the process for the rapid wetting of fabrics.

EXAMPLE 2

As described in Example 1, a fabric was inserted into the machine, however, the action portion was not oscillated. No significant release of air bubbles from the fabric was observed. A syringe was filled with the aqueous dark blue solution of a dyestuff and the tip of the attached syringe needle was inserted into the 0.5 Inch space between the fabric and the treatment portion, approximately in the area near the center of the action portion. The oscillation of the action portion, as described in Example 1, was then started and thereafter a small amount of dyestuff was injected as a tracer material. The dyestuff nearly instantly penetrated the fabric in a small, confined area, staining the fabric at the penetration point and nearly instantly formed a small volume of concentrated dye solution in the water at the fabric surface opposite the fabric surface closest to the injection point. Only thereafter did the dye solution spread through the entire bath. This demonstrates the effectiveness of the process in forcing liquid into and through the interstices of a fabric.

EXAMPLE 3

The machine and the fabric were the same as used in Example 1. The tank was again filled with hot water as in Example 1. Without oscillating the action portion, the mounted fabric sample was inserted as in Example 1 but only for 1 Second, then pulled out of the water for 5 Seconds, and then this cycle was immediately repeated three more times for a total immersion time of 4 Seconds and for a total time in hot, wet condition above the water surface of 20 Seconds. The sample was then analyzed. The Water Extractables were shown to be 2.0% and the Spot Test indicated a residual polyvinyl alcohol content of 0.9%. Under these conditions, due to the removal and reinsertion of the fabric into the liquor, some agitation of the water at the water/fabric interface is achieved, simulating to a degree a conventional desizing process.

EXAMPLE 4

A sample was processed exactly as in Example 3, except that in this Example the action portion was oscillated at a frequency of 2000 Cycles per Minute and an Amplitude of 0.125 Inches, resulting in an Effectiveness Factor F of 250 (Inches×Cycles/Minute).

The Extraction Analysis indicated 0.9% Water Extractables and the Spot Test indicated a residual amount of 0.2% polyvinyl alcohol, demonstrating the effectiveness of the process for a greatly accelerated removal of contaminants, such as size.

EXAMPLE 5

A sample was processed as in Example 3, except that in this case a machine substantially as shown in FIG. 2 was used in which the action portion motion is more precisely perpendicular to the plane of the fabric than in the machine shown in FIG. 1. Also, in this case an action portion 12 Inches wide and 6 Inches long was used.

The treatment portion was oscillated at 2000 Cycles per Minute at an amplitude of 0.063 Inches, resulting in an Effectiveness Factor F of 126 Inches×Cycles/Minute. The Extraction Analysis showed residual Water Extractables of 0.8% and the Spot Test showed a residual polyvinyl alcohol content of 0.1%, demonstrating the great effectiveness of this embodiment of the process.

What is claimed is:

1. An apparatus for delivering a plane of liquid against a textile fabric having a face and interstices comprising:
   (a) a tank for containing the liquid;
   (b) means for transporting said textile fabric through said tank and liquid therein;
   (c) a member including a first end portion and a second end portion positioned substantially within said tank; and
   (d) a means for oscillating said member at a product of frequency and amplitude of 75 to 1500 inches×cycles per minute, thereby creating a plane of the liquid substantially perpendicular to said face of said textile fabric for achieving rapid and repeated penetration of liquid into said interstices and interchange between liquid in said tank and liquid trapped in said interstices.

2. An apparatus for delivering a plane of liquid against a textile fabric as defined in claim 1, further comprising a means for pivotally connecting said second end portion of said member to said tank.

3. An apparatus for delivering a plane of liquid against a textile fabric as defined in claim 2, wherein said means for pivotally connecting said second end portion of said member to said tank further comprises a pin and associated socket.

4. An apparatus for delivering a plane of liquid against a textile fabric as defined in claim 2, wherein said oscillating means further comprises a linking arm including a first end portion and a second end portion where said second end portion of said linking arm is pivotally connected to said first end portion of said member and a means for oscillating said first end portion of said linking arm.

5. An apparatus for delivering a plane of liquid against a textile fabric as defined in claim 4, wherein said oscillating means includes a pulley pivotally connected to said first end portion of said linking arm and a means for driving said pulley.

6. An apparatus for delivering a plane of liquid against a textile fabric as defined in claim 5, wherein said means for driving said pulley includes an endless element and a means to drive said endless element.

7. An apparatus for delivering a plane of liquid against a textile fabric as defined in claim 6, wherein said endless element is a belt.

8. An apparatus for delivering a plane of liquid against a textile fabric as defined in claim 7, wherein said means to drive said endless element further comprises a pulley operatively attached to a motor.

9. An apparatus for delivering a plane of liquid against a textile fabric as defined in claim 1, wherein said transporting means includes a roll for directing the textile fabric located within said tank.

10. An apparatus for delivering a plane of liquid against a textile fabric as defined in claim 1, wherein said transporting means includes a roll for directing the textile fabric positioned outside said tank.

11. An apparatus for delivering a plane of liquid against a textile fabric as defined in claim 1, wherein said transporting means includes a plurality of rolls for directing the textile fabric positioned outside said tank.

12. An apparatus for delivering a plane of liquid against a textile fabric as defined in claim 1, wherein said member includes a substantially flat front portion.

13. An apparatus ,for delivering a plane of liquid against a textile fabric as defined in claim 12, wherein said member includes a substantially flat back portion.

* * * * *